US008534795B2

(12) United States Patent
Nukui

(10) Patent No.: US 8,534,795 B2
(45) Date of Patent: Sep. 17, 2013

(54) IMAGE RECORDING APPARATUS

(75) Inventor: Kosuke Nukui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 135 days.

(21) Appl. No.: 13/301,626

(22) Filed: Nov. 21, 2011

(65) Prior Publication Data

US 2012/0127231 A1 May 24, 2012

(30) Foreign Application Priority Data

Nov. 24, 2010 (JP) ..... 2010-261268

(51) Int. Cl.
*B41J 2/165* (2006.01)

(52) U.S. Cl.
USPC ..... 347/33

(58) Field of Classification Search
CPC ..... B41J 2/16535; B41J 2/16585
USPC ..... 347/16, 19–21, 29, 30, 33, 35
See application file for complete search history.

(56) References Cited

U.S. PATENT DOCUMENTS

| | | | | |
|---|---|---|---|---|
| 5,225,852 | A | 7/1993 | Uchida et al. | |
| 5,912,680 | A | 6/1999 | Uchida et al. | |
| 6,196,654 | B1 | 3/2001 | Uchida et al. | |
| 6,341,854 | B1 | 1/2002 | Takemoto | |
| 6,499,841 | B1 | 12/2002 | Uchida et al. | |
| 7,300,135 | B2 * | 11/2007 | Takagi | 347/35 |
| 2002/0109746 | A1 | 8/2002 | Murakami et al. | |
| 2005/0190228 | A1 | 9/2005 | Takagi | |

FOREIGN PATENT DOCUMENTS

| | | | |
|---|---|---|---|
| JP | H04-219264 | A | 8/1992 |
| JP | H09-216354 | A | 8/1997 |
| JP | H11-291476 | A | 10/1999 |
| JP | 2000-037942 | A | 2/2000 |
| JP | 2001-219565 | A | 8/2001 |
| JP | 2004-136516 | A | 5/2004 |
| JP | 2005-238771 | A | 9/2005 |
| JP | 2010-158845 | A | 7/2010 |
| JP | 2010-188624 | A | 9/2010 |

* cited by examiner

*Primary Examiner* — An Do
(74) *Attorney, Agent, or Firm* — Baker & Botts L.L.P.

(57) ABSTRACT

An image recording apparatus includes: a sheet conveying unit; an ink ejection head having a nozzle and an ink ejection surface; a pretreatment liquid ejection head; a purge unit; a wiping unit having a wiper; a paper jam detection unit detecting a position when the recording sheet is jammed; and a maintenance control unit, wherein, when the paper jam detection unit detects a paper jam on the downstream side from the pretreatment liquid ejection head, the maintenance control unit performs a first maintenance operation, in which the purge unit discharges ink from the ink ejection head, and the wiping unit wipes the ink ejection surface with the wiper, and in the first maintenance operation, the maintenance control unit performs control such that a discharge amount of ink to be discharged from the ink ejection head decreases or the wiping speed when the ink ejection surface is wiped decreases.

8 Claims, 7 Drawing Sheets

IMAGE RECORDING APPARATUS

CROSS REFERENCE TO RELATED APPLICATION

The present application claims priority from Japanese Patent Application No. 2010-261268, which was filed on Nov. 24, 2010, the disclosure of which is herein incorporated by reference in its entirety.

TECHNICAL FIELD

The present invention relates to an image recording apparatus which ejects ink onto a recording sheet to perform recording.

BACKGROUND

Patent Document 1 describes an ink jet recording apparatus which ejects a reaction liquid (pretreatment liquid) containing a component capable of aggregating or precipitating ink components onto a recording sheet, and then ejects ink onto the recording sheet having the reaction liquid landed thereon to record an image on the recording sheet.

Patent Document 2 describes a technique in which, when a paper jam occurs in an ink jet recording apparatus and a user removes the jammed recording sheet, a purge operation is performed to discharge ink from a nozzle, and then ink attached to an ink ejection surface of an ink jet head is wiped by a wiper blade, thereby recovering the meniscus of the nozzle and removing ink on the ink ejection surface.

[Patent Document 1] JP-A-2000-37942

[Patent Document 2] JP-A-2005-238771

SUMMARY

In Patent Document 1, even when a paper jam occurs, it is necessary to recover the meniscus of the nozzle. At this time, it is considered that the same operation as described in Patent Document 2 is performed.

However, when a paper jam occurs in the ink jet recording apparatus described in Patent Document 1, the recording sheet having the reaction liquid landed thereon may come into contact with the ink ejection surface, and the reaction liquid may be attached to the ink ejection surface. If the reaction liquid is attached to the ink ejection surface, ink attached to the ink ejection surface is aggregated or precipitated, and the generated aggregate or precipitate (ink aggregated or precipitated by the pretreatment liquid) is solidly attached to the ink ejection surface. The aggregate or precipitate causes defective ink ejection.

For this reason, when a paper jam occurs in the inkjet recording apparatus described in Patent Document 1, even though the purge operation and wiping of the ink ejection surface by the wiper blade described in Patent Document 2 are performed, the aggregate or precipitate may not be sufficiently removed from the ink ejection surface. At the time of wiping of the ink ejection surface by the wiper, the aggregate or precipitate may spread over the ink ejection surface. As a result, defective ink ejection from the nozzle may occur. Further, wasteful ink consumption increases.

An object of the invention is to provide an image recording apparatus capable of reliably removing an aggregate or a precipitate attached to an ink ejection surface while suppressing wasteful ink consumption.

An image recording apparatus according to an aspect of the invention includes a sheet conveying unit for conveying a sheet along a sheet conveying path, an ink ejection head which has a nozzle ejecting ink onto the recording sheet being conveyed and an ink ejection surface in which an ejection port of the nozzle is formed, a pretreatment liquid ejection head which is arranged on the upstream side of the ink ejection head in the conveying direction of the recording sheet, and ejects a pretreatment liquid containing a component capable of aggregating or precipitating ink components onto the recording sheet being conveyed, a purge unit for forcibly discharging ink from the nozzle, a wiping unit having a wiper wiping the ink ejection surface, paper a jam detection unit for detecting a position in the sheet conveying path when the recording sheet is jammed, and a maintenance control unit for controlling the purge unit and the wiping unit. When the paper jam detection unit detects that a paper jam is detected on the downstream side from the pretreatment liquid ejection head in the conveying direction, the maintenance control unit performs a first maintenance operation, in which the purge unit forcibly discharges ink from the ink ejection head, and then the wiping unit wipes the ink ejection surface with the wiper, once or more. In the first maintenance operation, compared to a second maintenance operation capable of recovering the meniscus of the nozzle and removing ink attached to the ink ejection surface, the maintenance control unit performs control such that the discharge amount of ink to be discharged from the ink ejection head by the purge unit decreases or the wiping speed when the ink ejection surface is wiped by the wiping unit decreases.

According to the invention, in the first maintenance operation, when the amount of ink to be discharged by the purge unit is small compared to the second maintenance operation, the amount of ink remaining on the ink ejection surface immediately after ink discharge decreases, such that the frictional force between the wiper and the ink ejection surface increases. Therefore, when the recording sheet having the pretreatment liquid landed thereon is jammed, it is possible to reliably remove an aggregate or precipitate attached to the ink ejection surface while suppressing wasteful ink consumption. Further, the amount of ink consumption in the first maintenance operation decreases.

In the first maintenance operation, when the wiping speed when the ink ejection surface is wiped by the wiper is slow compared to the second maintenance operation, the recovery force when the wiper deformed by moving while coming into contact with the ink ejection surface returns to the original state increases, such that the force of the wiper for wiping the ink ejection surface increases. Therefore, it is possible to reliably remove an aggregate or precipitate attached to the ink ejection surface while suppressing wasteful ink consumption when purging or wiping is repeatedly performed many times.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, a preferred embodiment of the invention will be described.

Figure 1:
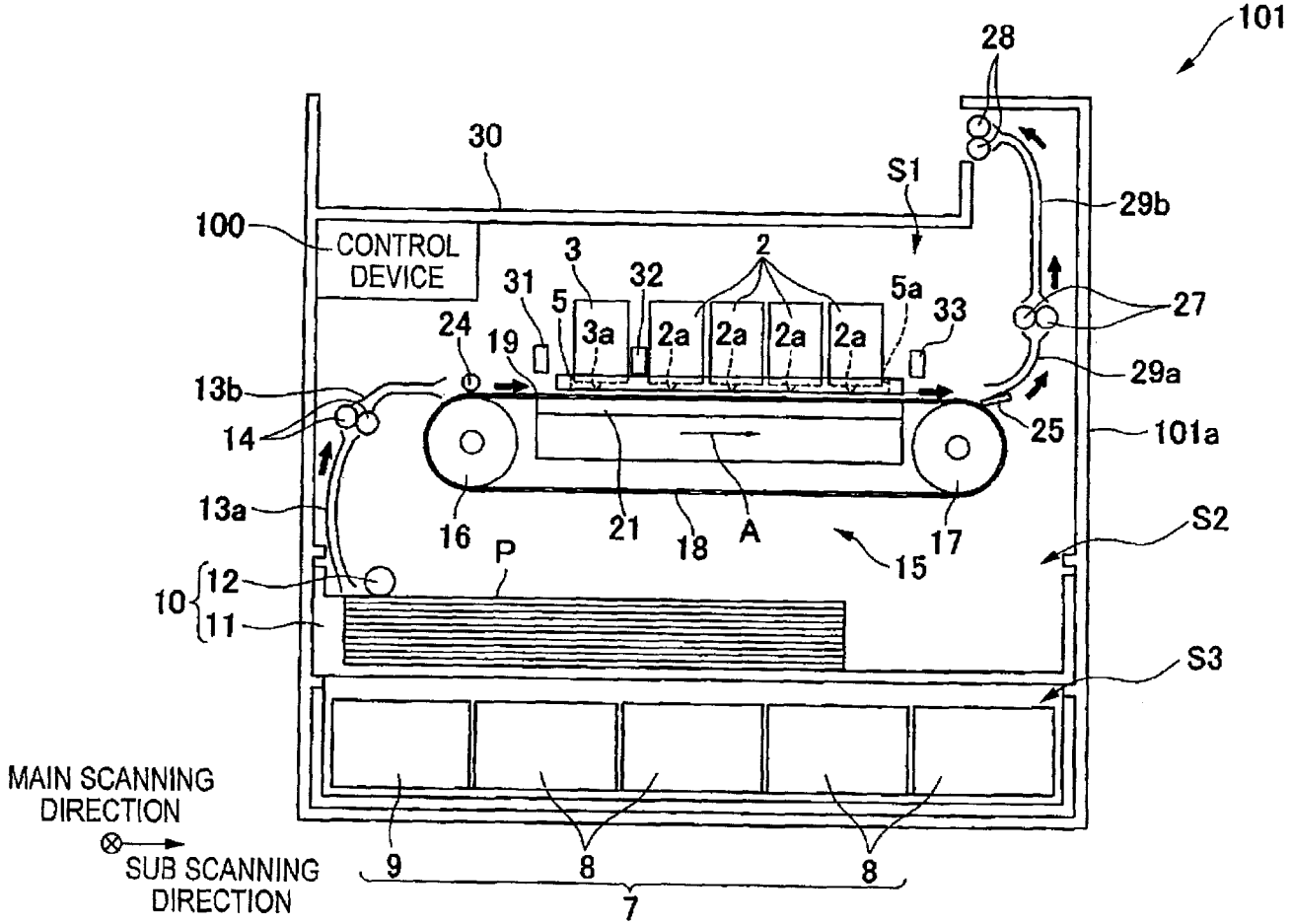
FIG. 1 is a schematic configuration diagram of a printer according to an embodiment of the invention.

As shown in FIG. 1, a printer 101 (image recording apparatus) has a casing 101*a* substantially having a rectangular parallelepiped shape, and a sheet discharge section 30 is provided at the upper part of the casing 101*a*. The inside of the casing 101*a* is divided into three spaces S1 to S3 in order from above. In the space S1 are arranged four ink ejection heads 2 which eject ink of magenta, cyan, yellow, and black, an improvement liquid ejection head 3 (pretreatment liquid ejection head) which ejects an image quality improvement liquid (pretreatment liquid, and hereinafter, simply referred to as an improvement liquid) for improving image quality, a conveying mechanism 15 which conveys a recording sheet P in a conveying direction A, and the like. In the spaces S2 and S3, a feeder unit 10 and a tank unit 7 which are detachably mounted in the casing 101*a* are arranged. Inside the tank unit 7, four ink tanks 8 and one improvement liquid tank 9 are accommodated. In the feeder unit 10, a plurality of recording sheets P are arranged in an overlapping manner. In the space S1, a control device 100 which controls the operation of the printer 101 is provided.

Figure 2:
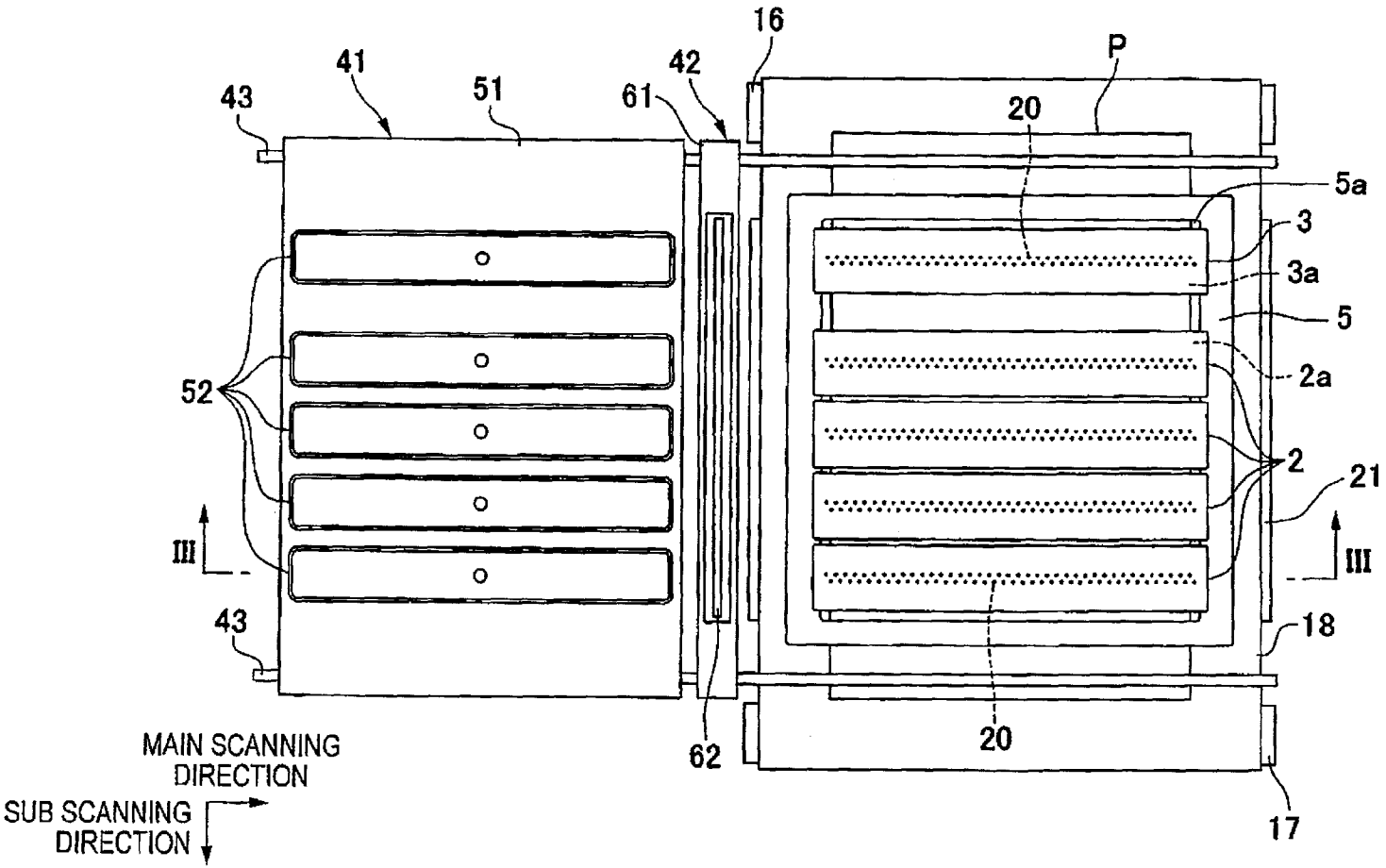
FIG. 2 is a plan view of a head, a cap unit, and a wiping unit of FIG. 1.
Figure 3:
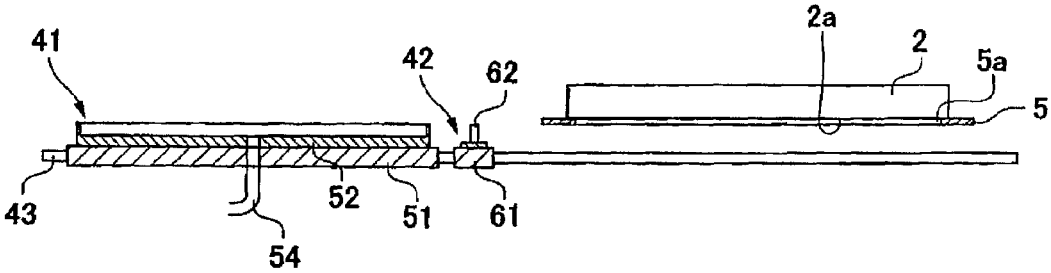
FIG. 3 is a sectional view taken along the line III-III of FIG. 2.

As shown in FIGS. 1 and 2, the five heads 2 and 3 are so-called line heads which substantially have a rectangular parallelepiped shape elongated in a main scanning direction (a left-right direction of FIG. 2) perpendicular to the conveying direction A, and are arranged along the conveying direction A. Specifically, in the conveying direction A, the improvement liquid ejection head 3 is arranged on the most upstream side, and the four ink ejection head 2 are arranged on the downstream side of the improvement liquid ejection head 3. With regard to the four ink ejection heads 2, the ink ejection heads 2 which eject ink of cyan, magenta, yellow, and black are arranged in order from the upstream side of the conveying direction A.

The heads 2 and 3 have the same configuration but store different types of liquids, and are laminates in which a flow channel unit and an actuator are bonded to each other. An ink flow channel including a pressure chamber is formed in the flow channel unit, and the actuator applies a pressure to ink in the pressure chamber. A surface of the flow channel unit facing the conveying mechanism 15 is an ejection surface in which ejection ports of nozzles 20 is formed. An ejection surface 3*a* of the improvement liquid ejection head 3 has a plurality of ejection ports arranged in the main scanning direction, and the improvement liquid is ejected therefrom. An ejection surface 2*a* of the ink ejection head 2 is the same as the ejection surface 3*a*, and ink is ejected therefrom. The length of each of the ejection surfaces 2*a* and 3*a* in the main scanning direction is greater than the width of the recording sheet P.

Figure 4:
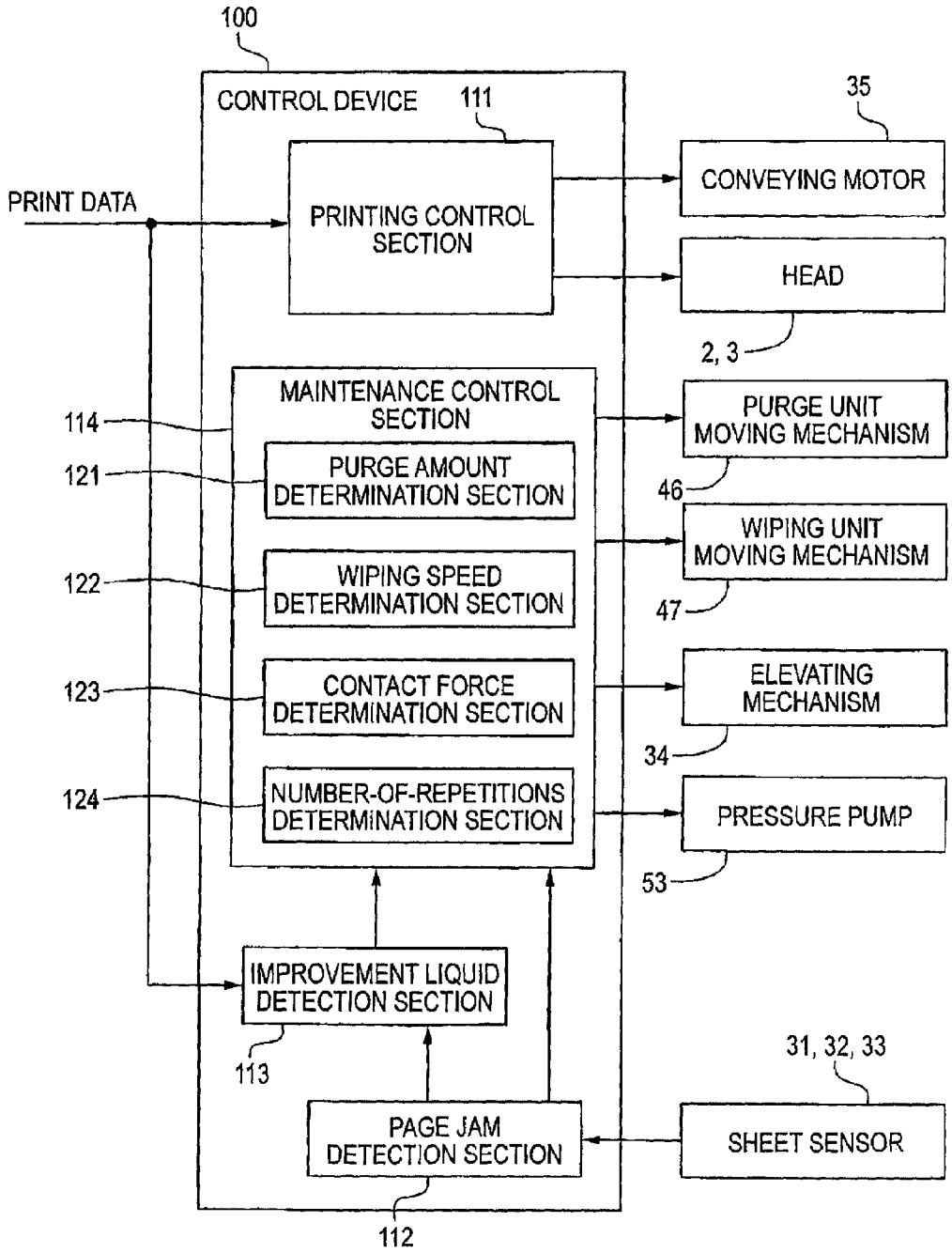
FIG. 4 is a functional block diagram of a control device of FIG. 1.

As shown in FIG. 2, the five heads 2 and 3 are supported by a support frame 5 substantially having a rectangular shape. The five ejection surfaces 2*a* and 3*a* are exposed from a through hole 5*a* formed inside the support frame 5. The support frame can be moved up and down by an elevating mechanism 34 (see FIG. 4), and is moved up and down along with the heads 2 and 3. FIG. 2 shows the arrangement form of the nozzles 20 when viewed from the front of the paper to the rear in the ejection surfaces 2*a* and 3*a* of the heads 2 and 3 which are primarily on the lower side in plan view and cannot be viewed.

The four ink tanks 8 respectively store ink of four colors, and the improvement liquid tank 9 stores the improvement liquid. Ink of a corresponding color is supplied from the ink tank 8 to the ink ejection head 2, and the image quality improvement liquid is supplied from the improvement liquid tank 9 to the improvement liquid ejection head 3. The tanks 8 and 9 and the heads 2 and 3 are connected through flexible tubes. When ink is pigment-based ink, the improvement liquid is a liquid which comes into contact with ink and aggregates ink. When ink is dye-based ink, the improvement liquid is a liquid which comes into contact with ink and precipitates ink.

Inside the printer 101, as indicated by a bold arrow in FIG. 1, a sheet conveying path through which the recording sheet P is conveyed is formed from the feeder unit 10 to the sheet discharge section 30. The feeder unit 10 has a feed roller 12 and a feed motor, in addition to a sheet feeding tray 11 which can store a plurality of recording sheets P. Of these, the sheet feeding tray 11 is detachably mounted in the casing 101*a*. The feed motor is driven to rotate the feed roller 12. The feed roller 12 feeds the uppermost recording sheet P in the sheet feeding tray 11. The fed recording sheet P is sent to the conveying mechanism 15 by guides 13*a* and 13*b* and a feed roller pair 14.

The conveying mechanism 15 has two belt rollers 16 and 17, an endless conveying belt 18 which is wound so as to be stretched between the two rollers 16 and 17, and a conveying motor 35 (see FIG. 4) which rotates the belt roller 17. Outside the conveying belt 18, a pressing roller 24 is arranged to face the belt roller 16, and a separating member 25 is arranged to face the belt roller 17. A platen 21 is arranged inside the conveying belt 18.

As shown in FIG. 2, the width of the conveying belt 18 (the length in the main scanning direction) is slightly greater than the width of each of the heads 2 and 3.

The platen 21 is formed to be slightly longer in the main scanning direction than the length of each of the recording sheet P and the conveying belt 18.

As shown in FIG. 1, the upper surface of the platen 21 supports an upper loop of the conveying belt 18 from the inner circumference side. Thus, a conveying surface 19 of the upper loop of the conveying belt 18 faces the ejection surfaces 2*a* and 3*a* in parallel, and a gap suitable for image formation is formed between the ejection surfaces 2*a* and 3*a* and the conveying surface 19.

On the upstream side of the conveying mechanism 15, the pressing roller 24 is pressed toward the belt roller 16 by an elastic member (for example, a spring). The recording sheet P supplied from the feeder unit 10 is pressed against the conveying surface 19 by the pressing roller 24. The pressing roller 24 is a driven roller and rotates with the rotation of the conveying belt 18.

In the sheet conveying path, sheet sensors 31 to 33 are arranged on the direct upstream side and the direct downstream side of the improvement liquid ejection head 3 and on the direct downstream side of the most downstream-side ink ejection head 2. The sheet sensor 31 is a sensor which detects the recording sheet P immediately before entering the arrangement region of the heads 2 and 3. In this embodiment, the ejection timing from each of the heads 2 and 3, or the like is determined on the basis of the leading end detection timing of the recording sheet P by the sheet sensor 31, the conveying speed of the recording sheet P, or the like. As the sheet sensor 31, a sensor having comparatively high precision is used such that the improvement liquid or ink is accurately landed.

The two sheet sensors 32 and 33 are arranged so as to sandwich the four ink ejection heads 2 therebetween. The upstream-side sheet sensor 32 detects the recording sheet P which is conveyed to the downstream side of the improvement liquid ejection head 3. The downstream-side sheet sensor 33 detects the recording sheet P on which image formation is completed. Unlike the sheet sensor 31, the sheet sensors 32 and 33 need not detect the leading end of the recording sheet P with satisfactory precision. It should suffice that the sheet sensors 32 and 33 detect the leading end or trailing end of the recording sheet P having passed. For this reason, as the sheet sensors 32 and 33, sensors having low precision are used compared to the sheet sensor 31.

The separating member 25 is provided on the direct downstream side of the conveying mechanism 15. The separating member 25 is arranged such that the leading end thereof enters between the recording sheet P and the conveying belt 18. The separating member 25 separates the recording sheet P from the conveying surface 19 and guides the recording sheet P to downstream-side guides 29*a* and 29*b*.

Two sets of feed roller pairs 27 and 28 and two sets of guides 29*a* and 29*b* are arranged between the conveying mechanism 15 and the sheet discharge section 30. The feed roller pairs 27 and 28 are driven under the control of the control device 100, such that the recording sheet P separated from the conveying surface 19 is guided and fed to the sheet discharge section 30.

The printer 101 includes a cap unit 41 and a wiping unit 42 which are used for the maintenance of the heads 2 and 3. In a state where purging or wiping described below is performed, the cap unit 41 and the wiping unit 42 are arranged laterally in relation to the heads 2 and 3 (on the left side of FIG. 2) in the main scanning direction.

The cap unit 41 includes a substrate 51, five purge caps 52, and the like. The substrate 51 is a plate member substantially having a rectangular shape. The substrate 51 is supported by two guide rails 43 extending in the main scanning direction (the direction perpendicular to the sub scanning direction) at both end portions in the sub scanning direction, and is movable in the main scanning direction along the guide rails 43 by a cap unit moving mechanism 46 (see FIG. 4).

The five purge caps 52 are arranged in the upper surface of the substrate 51 at the same intervals as the heads 2 and 3. When the substrate 51 moves to a position facing the heads 2 and 3, the five purge caps 52 respectively face the heads 2 and 3. If the heads 2 and 3 are moved down by the elevating mechanism 34 in a state of facing the heads 2 and 3, the five purge caps 52 respectively cover the ejection surfaces 2*a* and 3*a*.

A pressure pump 53 (see FIG. 4) is connected to the halfway path of the heads 2 and 3 and the ink tanks 8 and 9. If the pressure pump 53 is driven in a state where the ejection surfaces 2*a* and 3*a* of the heads 2 and 3 are covered with the purge caps 52, the pressure in the heads 2 and 3 increases, and the improvement liquid, ink, air bubbles, and the like thickened in the heads 2 and 3 are forcibly discharged to the purge caps 52 (pressure purging). The purge caps 52 are connected to a waste liquid tank (not shown) through tubes 54. The discharged improvement liquid, ink, and the like are stored in the waste liquid tank. In this embodiment, the combination of the cap unit 41, the elevating mechanism 34, and the pressure pump 53 correspond to a purge unit of the invention.

The wiping unit 42 is arranged on the right side of the cap unit 41 in FIG. 2, and includes a substrate 61 and a wiper 62. The substrate 61 is a plate member substantially having a rectangular shape. The substrate 61 is supported by guide rails 43 at both end portions in the sub scanning direction, and is movable in the main scanning direction by a wiping unit moving mechanism 47 (see FIG. 4).

The wiper 62 is a plate-shaped elastic member made of a rubber material to substantially have a rectangular shape elongated in the sub scanning direction. If the heads 2 and 3 are moved down by the elevating mechanism 34 in a state where the substrate 61 faces the heads 2 and 3, the leading end portion of the wiper 62 comes into contact with the ejection surfaces 2*a* and 3*a* of the heads 2 and 3. In this state, if the substrate 61 is moved in the main scanning direction, the ejection surfaces 2*a* and 3*a* are wiped by the wiper 62, such that the improvement liquid and ink attached to the ejection surfaces 2*a* and 3*a* and ink aggregated or precipitated by the improvement liquid are removed (wiping). In this embodiment, the combination of the wiping unit 42 and the elevating mechanism 34 correspond to a wiping unit of the invention.

Next, the control device 100 which controls the printer 101 will be described. The control device 100 is constituted by hardware, such as a CPU (Central Processing Unit), a ROM (Read Only Memory), and a RAM (Random Access Memory), software, such as a control program stored in the ROM or the like, and the like. Hardware, software, and the like constitute a printing control section 111, a paper jam detection section 112, an improvement liquid detection section 113, a maintenance control section 114, and the like.

When printing is performed in the printer 101, the printing control section 111 controls the heads 2 and 3, the conveying motor 35 (belt roller 17), and the like on the basis of print data transferred from a host computer, or the like.

The paper jam detection section 112 detects whether or not a paper jam occurs in the printer 101 and whether the paper jam occurs on the upstream side or the downstream side of the improvement liquid ejection head 3 on the basis of the detection results of the sheet sensors 31 to 33. Specifically, when the leading end of the recording sheet P has not been detected by the sheet sensor 32 within a predetermined time since the leading end of the recording sheet P has been detected by the sheet sensor 31, it is detected that a paper jam has occurred on the upstream side from the improvement liquid ejection head 3.

When the leading end of the recording sheet P has been detected by the sheet sensor 32 within a predetermined time since the leading end of the recording sheet P has been detected by the sheet sensor 31, and then the trailing end of the recording sheet P has not been detected by the sheet sensor 33 within a predetermined time, it is detected that a paper jam occurs on the downstream side from the improvement liquid ejection head 3, that is, a paper jam occurs when at least a part of a portion of the recording sheet P where the improvement liquid has landed is advanced to the downstream side from the improvement liquid ejection head 3.

When a paper jam has been detected by the paper jam detection section 112, the improvement liquid detection section 113 detects the improvement liquid landing on the jammed recording sheet P and the amount of the landed improvement liquid. Specifically, it is determined whether printing is performed on the recording sheet P using both the improvement liquid and ink or printing is performed using only ink from print data transferred from the host computer. When printing is performed using both the improvement liquid and ink, and when the paper jam detection section 112 detects the occurrence of a paper jam on the downstream side from the improvement liquid ejection head 3, the improvement liquid landing on the recording sheet P is detected. The amount of the improvement liquid landed on the recording sheet P is detected on the basis of print data or the like.

The maintenance control section 114 has a purge amount determination section 121, a wiping speed determination section 122, a contact force determination section 123, and a number-of-repetitions determination section 124. The purge amount determination section 121 determines the amount (purge amount) of the improvement liquid and ink to be discharged from the heads 2 and 3 at the time of pressure purging. The wiping speed determination section 122 determines the moving speed (wiping speed) of the wiper 62 when wiping is performed.

The contact force determination section 123 determines the contact force of the wiper 62 with respect to the ejection surfaces 2*a* and 3*a*. The contact force of the wiper 62 with respect to the ejection surfaces 2*a* and 3*a* changes by moving up and down the heads 2 and 3 (support frame 5). As the ejection surfaces 2*a* and 3*a* become close to the wiping unit 42, the contact force increases. The number-of-repetitions determination section 124 determines the number of repetitions of pressure purging and wiping.

The maintenance control section 114 controls the elevating mechanism 34, the moving mechanisms 46 and 47, the pressure pump 53, and the like such that, at the time of pressure purging, the improvement liquid or ink is discharged by the amount determined by the purge amount determination section 121, at the time of wiping, the wiper 62 comes into contact with the ejection surfaces 2*a* and 3*a* with the contact force determined by the contact force determination section 123 and the wiper 62 moves at the wiping speed determined by the wiping speed determination section 122, and pressure purging and wiping are repeated by the number of repetitions determined by the number-of-repetitions determination section 124.

Next, a printing operation by the printer 101 will be described below. If print data is transferred from the host computer to the control device 100, the recording sheet P is fed from the sheet feeding tray 11 by the feed roller 12, and the recording sheet P is conveyed toward the downstream side of the sheet conveying path by the feed rollers 14, 27, and 28 and the conveying mechanism 15.

When printing is performed on the recording sheet P with high image quality, the improvement liquid ejection head 3 ejects the improvement liquid toward the recording sheet P, and a transparent image is formed on the recording sheet P with the same image pattern as that being ejected from the ink ejection head 2. Thereafter, when the recording sheet P passes directly below the ink ejection head 2, ink is ejected to print a color image on the recording sheet P. In this case, ink is landed onto the position of the recording sheet P where the improvement liquid has landed. For this reason, ink landed on the recording sheet P reacts with the improvement liquid and is aggregated or precipitated, and ink does not easily soak through the recording sheet P. Therefore, the edge of an image to be printed is not easily blurred, thereby increasing printing quality.

When printing is performed on the recording sheet P with low image quality, the improvement liquid is not ejected from the improvement liquid ejection head 3, and only when the recording sheet P passes directly below the ink ejection head 2, ink is ejected from the ink ejection head 2 to print a color image on the recording sheet P. In this case, since ink has landed on the recording sheet P on which the improvement liquid has not landed, landed ink easily soaks through the recording sheet P. For this reason, the edge of an image to be printed is easily blurred, and printing quality is degraded. Meanwhile, because the improvement liquid is not ejected from the improvement liquid ejection head 3, the printing speed increases proportionately.

Thereafter, the recording sheet P on which an image is printed is discharged to the sheet discharge section 30 by the feed roller pairs 27 and 28. In this way, the printing operation by the printer 101 ends.

Figure 5:
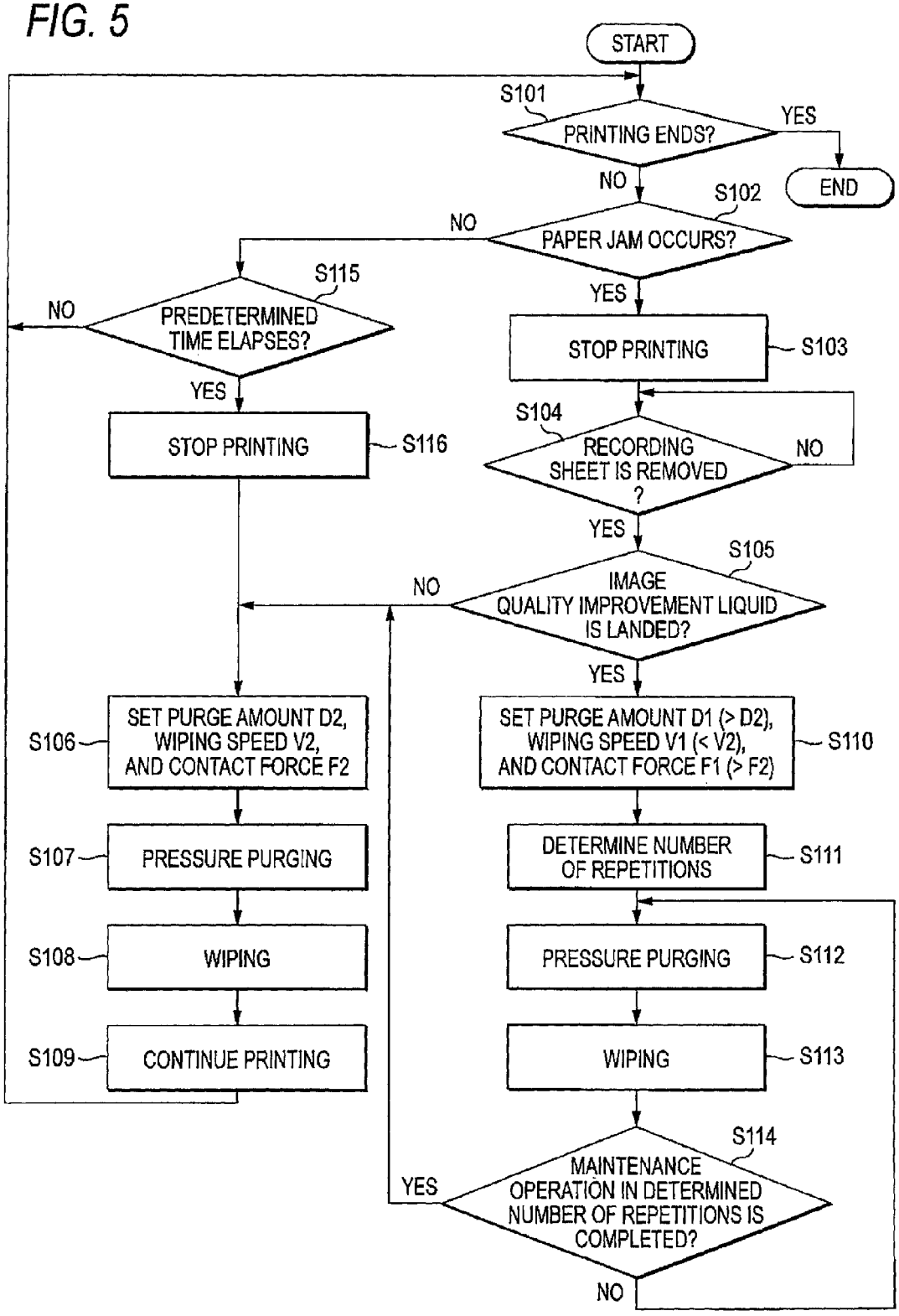
FIG. 5 is a flowchart showing a procedure of a maintenance operation when a paper jam occurs.

Next, the maintenance operation of the printer 101 during printing will be described. If printing is performed in the printer 101 in the above-described manner, the recording sheet P may be bent and hung up on the heads 2 and 3, and a paper jam may occur. When a paper jam occurs, the recording sheet P on which the improvement liquid or ink has landed comes into contact with the ejection surfaces 2*a* and 3*a* of the heads 2 and 3, such that the meniscus of the nozzles 20 may be destroyed or the improvement liquid landed on the recording sheet P is attached to the ejection surface 2*a* of the ink ejection head 2 to aggregate or precipitate ink. For this reason, the maintenance of the heads 2 and 3 is performed in the procedure shown in the flowchart of FIG. 5. The processing flow of the maintenance operation shown in FIG. 5 starts when printing starts.

In the printer 101, while printing is continuing (Step S101: NO, hereinafter, simply referred to as S101), it is detected whether or not a paper jam occurs (Step S102). If a paper jam is detected by the paper jam detection section 112 (S102: YES), printing (conveying of the recording sheet P and ink ejection) is stopped (S103).

A stand-by state is maintained until the user removes the jammed recording sheet P and the recording sheet P is not detected by any of the sheet sensors 31 to 33 (S104: NO). When the recording sheet P is not detected by any of the sheet sensors 31 to 33 (S104: YES), and when the improvement liquid detection section 113 does not detect the improvement liquid landing on the jammed recording sheet P (S105: NO), the purge amount is set to D2 (for example, 2 ml), the wiping speed is set to V2 (for example, 125 mm/s), and the contact force is set to F2 (S106).

At this time, the purge amount D2 is the minimum amount at which the meniscus of the improvement liquid or ink of the nozzles 20 can be reliably recovered. The wiping speed V2 is the wiping speed such that the improvement liquid or ink attached to the ejection surfaces 2*a* and 3*a* can be sufficiently removed over a temperature range which should secure the operation of the printer 101 when an experiment is performed in which wiping is performed in the printer 101 at various wiping speeds in various temperature environments with the contact force F2 of the wiper 62 with respect to the ejection surfaces 2*a* and 3*a*.

Figure 6A:
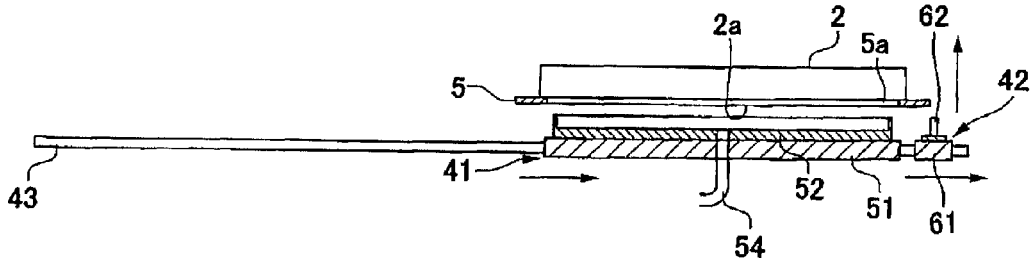
FIGS. 6A and 6B are diagrams showing movement of a cap unit when purging is performed.
Figure 6B:
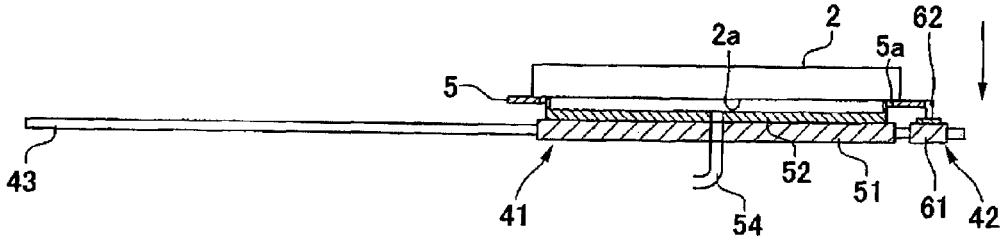

Next, as shown in FIG. 6A, the heads 2 and 3 are moved up, and the cap unit 41 and the wiping unit 42 are moved to a position where the purge caps 52 face the heads 2 and 3. Subsequently, as shown in FIG. 6B, the heads 2 and 3 are moved down to cover the ejection surfaces 2*a* and 3*a* with the purge caps 52, and the pressure pump 53 is driven to perform pressure purging. At this time, ink or the improvement liquid is discharged from the heads 2 and 3 by the purge amount D2 (S107).

Figure 7A:
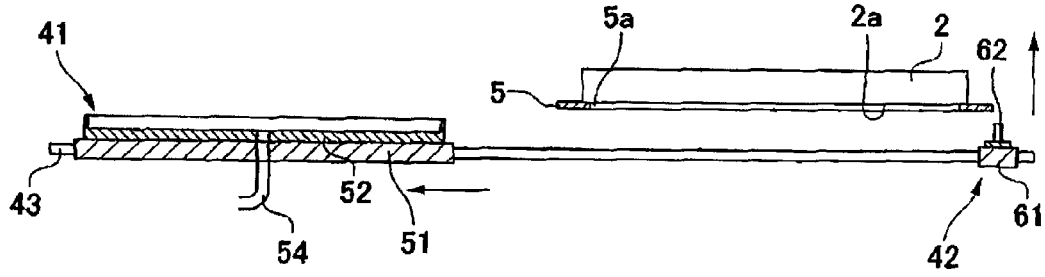
FIGS. 7A and 7B are diagrams showing movement of a wiping unit when wiping is performed.
Figure 7B:
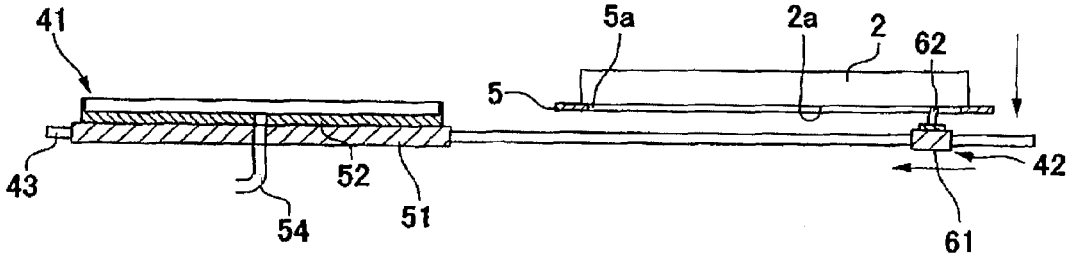

Next, as shown in FIG. 7A, the heads 2 and 3 are moved up, and then the cap unit 41 is moved to the original position. Subsequently, as shown in FIG. 7B, the heads 2 and 3 are moved down to the position where the contact force of the wiper 62 with respect to the ejection surfaces 2*a* and 3*a* becomes F2. In this state, the wiping unit 42 is moved to the original position at the wiping speed V2 set in S103 to perform wiping (S108). Thus, the improvement liquid, ink, or the like attached to the ejection surfaces 2*a* and 3*a* is removed by pressure purging. After wiping, printing is continued (S109) and the processing returns to S101.

At this time, the maintenance operation including pressure purging in S107 and wiping in S108 corresponds to a second maintenance operation of the invention.

When it is detected that the improvement liquid has landed on the jammed recording sheet P (S105: YES), the purge amount is set to a purge amount D1 (for example, 1 ml) smaller than the purge amount D2 in the second maintenance operation, the wiping speed is set to a wiping speed V1 (for example, 100 mm/s) lower than the wiping speed V2 in the second maintenance operation, and the contact force of the wiper 62 with respect to the ejection surfaces 2*a* and 3*a* is set to a contact force F1 greater than the contact force F2 in the second maintenance operation (S110).

Next, the number of repetitions of pressure purging and wiping is determined such that the greater the amount of the improvement liquid detected by the improvement liquid detection section 113, the greater the number of repetitions of pressure purging and wiping (S111).

As shown in FIGS. 6A to 7B, pressure purging (S112) and wiping (S113) are repeatedly performed by the number of repetitions determined in S111 (S114: NO). At the time of pressure purging in S112, ink and the improvement liquid are discharged by the purge amount D1 determined in S110, and at the time of wiping in S113, the wiping unit 42 is moved at the wiping speed V1 determined in S110 in a state where the heads 2 and 3 are moved down to the position where the contact force of the wiper 62 with respect to the ejection surfaces 2*a* and 3*a* becomes the contact force F1 determined in S110. The maintenance operation including pressure purging and wiping in S112 to S114 corresponds to a first maintenance operation of the invention.

Thereafter, after the same maintenance operation (second maintenance operation) as in S106 to S108 is further performed, printing is continued (S109).

When the improvement liquid has landed on the jammed recording sheet P, and when the recording sheet P comes into contact with the ink ejection head 2, the landed improvement liquid may be attached to the ejection surface 2*a*. If the improvement liquid has landed on the ejection surface 2*a*, ink attached to the ejection surface 2*a* may react with the improvement liquid and may be aggregated or precipitated. Aggregated or precipitated ink has high viscosity compared to ink prior to aggregation or precipitation. For this reason, in this case, even when pressure purging and wiping are performed in the same manner as when the improvement liquid has not landed on the ejection surface 2*a*, aggregated or precipitated ink on the ejection surface 2*a* may not be sufficiently removed and may spread on the ejection surface 2*a*, in which the ejection ports of the nozzles 20 are formed, by wiping, and as a result, ink may not be normally ejected from the nozzles 20. Alternatively, pressure purging or wiping may be repeatedly performed many times so as to reliably remove aggregated ink on the ejection surface 2*a*, causing wasteful ink consumption.

In contrast, in this embodiment, when it is detected that the improvement liquid has landed on the jammed recording sheet P (S102: YES, S105: YES), the purge amount decreases, the wiping speed decreases, and the contact force of the wiper 62 with respect to the ejection surface 2*a* increases compared to when it is not detected that the improvement liquid has landed (S102: NO, S105: NO).

If the purge amount decreases, after pressure purging, the amount of the improvement liquid or ink to be attached to the ejection surface 2*a* decreases, and at the time of subsequent wiping, the frictional force between the wiper 62 and the ejection surface 2*a* increases. If the wiping speed of the wiper 62 decreases, the recovery force when the wiper 62 deformed by moving while coming into contact with the ejection surface 2*a* returns to the original state increases. If the contact force of the wiper 62 with respect to the ejection surface 2*a* increases, the frictional force between the wiper 62 and the ejection surface 2*a* at the time of wiping increases.

As a result, the force of the wiper 62 for wiping the ejection surface 2*a* at the time of wiping increases, making it possible to reliably remove aggregated or precipitated ink on the ejection surface 2*a* while suppressing wasteful ink consumption when pressure purging or wiping is repeated many times.

As the amount of the improvement liquid landed on the jammed recording sheet P increases, the amount of the improvement liquid to be attached to the ejection surface 2*a* is likely to increase, and a great amount of ink is likely to be aggregated or precipitated on the ejection surface 2*a*. In contrast, in this embodiment, as the amount of the improvement liquid landed on the jammed recording sheet P increases, the number of repetitions of pressure purging and wiping increases. Thus, it is possible to reliably remove aggregated or precipitated ink from the ejection surface 2*a*.

When it is detected that the improvement liquid has landed on the jammed recording sheet P, the purge amount decreases compared to when the improvement liquid is not detected. For this reason, at the time of pressure purging in S111, the meniscus of the improvement liquid or ink in the nozzles 20 may not be recovered.

However, in this embodiment, after the first maintenance operation (S111 to S113), since the second maintenance operation is performed by the purge amount greater than in the first maintenance operation, it is possible to reliably recover the meniscus of the improvement liquid or ink in the nozzles 20. In the second maintenance operation, since the wiping speed is high compared to the first maintenance operation, it is possible to quickly wipe ink or the improvement liquid on the ejection surfaces 2*a* and 3*a*.

In this embodiment, as described above, even when it is detected that the improvement liquid has landed on the jammed recording sheet P, similarly to when it is not detected that the improvement liquid has landed on the jammed recording sheet P, the second maintenance operation is performed. At this time, the meniscus of the improvement liquid or ink in the nozzles 20 is reliably recovered. Thus, in the first maintenance operation, it is preferable that pressure purging in S112 is not performed (the purge amount D2 is zero) because the frictional force between the wiper 62 and the ejection surface 2*a* increases.

When this happens, however, the ejection surfaces 2*a* and 3*a* are likely to be damaged at the time of wiping by the wiper 62. For this reason, in this embodiment, in S112, pressure purging is performed by a purge amount smaller than in S107, such that the improvement liquid or ink is attached to the ejection surfaces 2*a* and 3*a*, thereby preventing the ejection surfaces 2*a* and 3*a* from being damaged by the wiper 62 at the time of wiping.

At the time of pressure purging (S107) which is performed when it is not detected that the improvement liquid has landed on the jammed recording sheet P, the purge amount D1 is the minimum amount at which the meniscus of the improvement liquid or ink in the nozzles 20 can be recovered. Thus, it is possible to significantly suppress the amount of the improvement liquid or ink to be discharged by pressure purging.

When a paper jam does not occur (S102: NO), printing continues until a predetermined time elapses since the maintenance operation was last performed (S115: NO), and when the predetermined time has elapsed, the same maintenance as in S106 to S109 is performed. The maintenance operation which is performed regardless of a paper jam corresponds to a third maintenance operation of the invention. In the third maintenance operation, the purge amount, the wiping speed, and the contact force of the wiper 62 with respect to the ejection surfaces 2*a* and 3*a* are respectively equal to the purge amount D2, the wiping speed V2, and the contact force F2 in the second maintenance operation.

In this embodiment, as described above, in the second maintenance operation and the third maintenance operation, the purge amount, the wiping speed, and the contact force of the wiper 62 with respect to the ejection surfaces 2*a* and 3*a* are identical. Thus, it is possible to perform the second maintenance operation and the third maintenance operation under the same control, thereby simplifying the control of the printer 101.

As described above, the third maintenance operation which is performed regardless of a paper jam may be performed each time a predetermined time elapses during printing or may be performed, for example, when a state where printing is not performed continues for a long time, when the user operates the printer 101 to instruct maintenance, or the like.

Next, modifications in which various changes are made to this embodiment will be described. The same parts as those in this embodiment are represented by the same reference numerals, and descriptions thereof will be appropriately omitted.

Although in the foregoing embodiment, in the first maintenance operation and the second maintenance operation, all the purge amount, the wiping speed, and the contact force of the wiper 62 with respect to the ejection surfaces 2*a* and 3*a* are changed, some of the purge amount, the wiping speed, and the contact force may be changed, and others may be identical.

Although in the foregoing embodiment, the number of repetitions of pressure purging and wiping changes depending on the amount of the improvement liquid landed on the jammed recording sheet P, the first maintenance operation may be performed such that pressure purging and wiping are performed once or repeatedly multiple times regardless of the amount of the improvement liquid landed on the jammed recording sheet P.

Although in the foregoing embodiment, when it is detected that the improvement liquid has landed on the jammed recording sheet P, after the first maintenance operation, the second maintenance operation is further performed, printing may be continued immediately after the first maintenance operation. This is applied when the landed amount of the improvement liquid is very small.

At the time of pressure purging (S112) of the first maintenance operation in which the purge amount is small, the meniscus of the improvement liquid or ink in the nozzles 20 may be recovered. In this case, after the first maintenance operation, pressure purging or the like is not further performed, thereby preventing the improvement liquid or ink from being wastefully discharged.

With pressure purging (S112) of the first maintenance operation, the meniscus of the improvement liquid or ink in the nozzles 20 cannot be recovered, and when the quality of an image to be subsequently printed is degraded, the third maintenance operation may be performed or the like in accordance with a user's instruction.

Although in the foregoing embodiment, at the time of pressure purging in the second maintenance operation, the purge amount D2 is the minimum amount at which the meniscus of the improvement liquid or ink in the nozzles 20 can be recovered, the purge amount D2 may be greater.

Although in the foregoing embodiment, in the first maintenance operation, pressure purging and wiping are performed for the improvement liquid ejection head 3, the invention is not limited thereto. The improvement liquid ejection head 3 is arranged on the upstream side in the conveying direction A from the ink ejection head 2. Thus, there is little possibility that, even when a paper jam occurs, a portion of the recording sheet P where ink has landed will come into contact with the ejection surface 3*a*. That is, there is little possibility that aggregated or precipitated ink will be attached to the ejection surface 3*a*.

Accordingly, for example, a wiper and a substrate supporting the wiper may be provided for each of the ink ejection head 2 and the improvement liquid ejection head 3. In this case, in the first maintenance operation, pressure purging may be performed only for the ink ejection head 2, and only the wiper corresponding to the ink ejection head 2 may be moved to perform wiping only for the ejection surface 2*a* of the ink ejection head 2.

Although in the foregoing example, when a paper jam occurs, the maintenance operation is performed uniformly for the ejection surfaces 2*a* of the four ink ejection heads 2, the invention is not limited thereto. For example, a sensor or the like which can detect the position of the recording sheet P in more detail when a paper jam occurs may be provided, and when a paper jam occurs, the maintenance operation may be performed for one or two adjacent ink ejection heads 2 in the conveying direction A with no ink ejection head 2 interposed therebetween with respect to the position where the paper jam occurs.

For example, although the sheet sensors 32 and 33 are arranged on the downstream side of the improvement liquid ejection head 3 so as to sandwich the four ink ejection heads 2 therebetween, the number of sheet sensors may increase and the sheet sensors may be arranged between the heads 3. Therefore, the paper jam position is accurately detected, and after the paper jam is detected, it becomes possible to specify a head 3 for which the maintenance operation is required, thereby suppressing wasteful ink consumption compared to the foregoing embodiment.

Specifically, when a paper jam occurs between two adjacent ink ejection heads 2, there is no other ink ejection head 2 between the two ejection heads 2 and the position where the paper jam occurs, and one of the two ink ejection heads 2 is sandwiched between the ink ejection head 2 other than the two ink ejection heads 2 and the position where the paper jam occurs. Thus, the maintenance operation is performed only for the two ink ejection heads 2.

When a paper jam occurs on the upstream side of the ink ejection head 2 arranged on the most upstream side (the leftmost side of FIG. 1) in the conveying direction A, there is no ink ejection head 2 on the upstream side from the position where the paper jam occurs. Thus, the maintenance operation is performed only for the single ink ejection head 2 on the most upstream side.

Similarly, when a paper jam occurs on the downstream side of the ink ejection head 2 arranged on the most downstream side (the rightmost side of FIG. 1) in the conveying direction A, there is no ink ejection head 2 on the downstream side from the position where the paper jam occurs. Thus, the maintenance operation is performed only for the single ink ejection head 2 on the most downstream side.

When a paper jam occurs at a position facing any ink ejection head 2, there is no other ink ejection head 2 between the head 2 and the position where the paper jam occurs, and the head 2 is sandwiched between the position where the paper jam occurs and another ink ejection head 2. Thus, the maintenance operation is performed only for the single ink ejection head 2 facing the paper jam position.

In this case, the maintenance operation is performed only for the ink ejection head 2 which is near the position where the paper jam occurs and in which the improvement liquid is likely to be attached to the ejection surface 2*a*. Meanwhile, the maintenance operation is not performed for the ink ejection head 2 which is distant from the position where the paper jam occurs and in which the improvement liquid is unlikely to be attached to the ejection surface 2*a*. Therefore, it is possible to suppress wasteful ink consumption.

Although in the foregoing embodiment, the purge amount, the wiping speed, and the contact force of the wiper 62 with respect to the ejection surfaces 2*a* and 3*a* in the third maintenance operation which is performed regardless of a paper jam are respectively equal to the purge amount D2, the wiping speed V2, and the contact force F2 in the second maintenance operation, the invention is not limited thereto. The purge amount in the third maintenance operation may be greater than the purge amount D2. The wiping speed in the third maintenance operation may be higher than the wiping speed V2. The contact force of the wiper 62 with respect to the ejection surfaces 2*a* and 3*a* in the third maintenance operation may be greater than the contact force F2.

Although in the foregoing embodiment, the image quality improvement liquid is ejected onto the recording sheet P before ink is ejected onto the recording sheet P, the pretreatment liquid which is ejected onto the recording sheet P before ink is ejected onto the recording sheet P may be a liquid other than the image quality improvement liquid.

Although in the foregoing embodiment, the improvement liquid or ink in the heads 2 and 3 is forcibly discharged by so-called pressuring purging in which ink or the improvement liquid in the heads 2 and 3 is pressurized to discharge ink from the nozzles 20, the invention is not limited thereto. Ink or the improvement liquid in the heads 2 and 3 may be forcibly discharged by so-called suction purging in which a suction pump is connected to halfway of the tube 54 connected to the purge cap 52, and the suction pump is driven in a state where the ejection surface 2*a* or 3*a* is covered with the purge cap 52, such that the space surrounded by the ejection surface 2*a* or 3*a* and the purge cap 52 has a negative pressure, and ink or the improvement liquid is sucked from the nozzles 20.

Although in the foregoing embodiment, both the ink ejection head 2 and the improvement liquid ejection head 3 are line heads, one of or both the ink ejection head 2 and the improvement liquid ejection heads 3 may be so-called serial heads which eject ink or the improvement liquid from the nozzles while reciprocating in the main scanning direction.

What is claimed is:

1. An image recording apparatus comprising:

a sheet conveying unit that conveys a recoding sheet along a sheet conveying path;

an ink ejection head which has a nozzle ejecting ink onto the recording sheet being conveyed and an ink ejection surface in which an ejection port of the nozzle is formed;

a pretreatment liquid ejection head which is arranged on the upstream side of the ink ejection head in a conveying direction of the recording sheet, and ejects a pretreatment liquid containing a component capable of aggregating or precipitating ink components onto the recording sheet being conveyed;

a purge unit that discharges ink from the nozzle;

a wiping unit that has a wiper wiping the ink ejection surface;

a paper jam detection unit that detects a position in the sheet conveying path when the recording sheet is jammed; and a maintenance control unit that is configured to control the purge unit and the wiping unit, wherein, when the paper jam detection unit detects a paper jam on the downstream side from the pretreatment liquid ejection head in the conveying direction, the maintenance control unit performs a first maintenance operation, in which the purge unit discharges ink from the ink ejection head, and then the wiping unit wipes the ink ejection surface with the wiper, once or more, and in the first maintenance operation, compared to a second maintenance operation capable of recovering the meniscus of the nozzle and removing ink attached to the ink ejection surface, the maintenance control unit performs control such that a discharge amount of ink to be discharged from the ink ejection head by the purge unit decreases or the wiping speed when the ink ejection surface is wiped by the wiping unit decreases.

2. The image recording apparatus according to claim 1, wherein, in the first maintenance operation, compared to the second maintenance operation, the maintenance control unit performs control such that the discharge amount of ink to be discharged from the ink ejection head by the purge unit decreases, and the wiping speed when the ink ejection surface is wiped by the wiping unit decreases.

3. The image recording apparatus according to claim 1, further comprising:

a pretreatment liquid detection unit that detects an amount of the pretreatment liquid landed on the jammed recording sheet, wherein the maintenance control unit performs control such that the larger the amount of the pretreatment liquid detected by the pretreatment liquid detection unit, the larger the number of repetitions of the first maintenance operation.

4. The image recording apparatus according to claim 1, wherein, in the first maintenance operation, the maintenance control unit performs control such that the wiper wipes the ink ejection surface with a contact force larger than a contact force when the wiper comes into contact with the ink ejection surface in the second maintenance operation.

5. The image recording apparatus according to claim 1, wherein the maintenance control unit performs control such that the second maintenance operation is performed after all the first maintenance operations are performed.

6. The image recording apparatus according to claim 1, wherein the maintenance control unit performs control such that a third maintenance operation in which the purge unit discharges ink from the ink ejection head by an amount equal to or larger than in the second maintenance operation, and then the wiping unit wipes the ink ejection surface at a wiping speed equal to or higher than in the second maintenance operation is performed regardless of a paper jam.

7. The image recording apparatus according to claim 6, wherein, in the third maintenance operation, the discharge amount of ink to be discharged from the ink ejection head by the purge unit is equal to the discharge amount of ink to be discharged from the ink ejection head by the purge unit in the second maintenance operation, and in the third maintenance operation, the wiping speed when the wiping unit wipes the ink ejection surface is equal to the wiping speed when the wiping unit wipes the ink ejection surface in the second maintenance operation.

8. The image recording apparatus according to claim 1, wherein a plurality of ink ejection heads are arranged along the conveying direction on the downstream side of the pretreatment liquid ejection head in the conveying direction, and when the paper jam detection unit detects a paper jam on the downstream side of the pretreatment liquid ejection head, the maintenance control unit performs control such that the first maintenance operation is performed only for one or two adjacent ink ejection heads with no ink ejection head interposed therebetween with respect to a position where the paper jam is detected.

* * * * *